United States Patent [19]

Sloop

[11] 3,938,166

[45] Feb. 10, 1976

[54] CAMERA SIDE STRAP

[76] Inventor: Conrad Beebe Sloop, 9092 Bermuda Drive, Huntington Beach, Calif. 92646

[22] Filed: Oct. 10, 1974

[21] Appl. No.: 513,761

[52] U.S. Cl. ..... 354/82; 354/293; 224/5 V; 224/28 R

[51] Int. Cl.[2] ..... G03B 29/00

[58] Field of Search ..... 354/82, 81, 293; 352/243; 224/5 V, 28 R, 28 J, 45 R

[56] References Cited

UNITED STATES PATENTS 2,961,937 11/1960 Karpf ..... 352/243

*Primary Examiner*—John F. Gonzales

*Attorney, Agent, or Firm*—Lindenberg, Freilich, Wasserman, Rosen & Fernandez

[57] ABSTRACT

A strap assembly for attachment to a typical 35mm camera, including a yoke with a middle portion lying against the right side of the camera and a pair of straps extending over the front or rear and then over the bottom of the camera and held by a knob threaded into the tripod socket of the camera. A finger strap mounted on the middle yoke portion is designed to firmly receive the middle, ring, and little fingers of the hand so that the camera cannot fall and yet these fingers can securely grasp the camera to hold it upright. The strap forms a loop whose axis is angled upwardly from the horizontal and inwardly towards the optical axis, so that a good grip can be obtained while the index finger of the hand is free to reach over the top of the camera to depress the shutter release button and the thumb is free to move the film advance lever.

10 Claims, 9 Drawing Figures

CAMERA SIDE STRAP

BACKGROUND OF THE INVENTION

This invention relates to apparatus for mounting on a camera.

In the course of taking pictures, the photographer often must hold the camera with one hand while he uses the other hand to make adjustments to the camera or changes lenses or other accessories. The grip of one hand is often insufficient to hold the camera, especially in the case of heavier cameras and lenses which have become more popular for serious photographers. A neck strap can provide security against dropping the camera, but it tends to restrict use of the camera, and even with a neck strap the photographer must grip the camera very tightly while manipulating it with one hand. A compact carrying device which enabled a photographper to securely grasp and manipulate a camera with one hand while providing security against dropping the camera, would facilitate the use of cameras.

SUMMARY OF THE INVENTION

In accordance with one embodiment of the present invention, a simple and compact device is provided which enables a camera to be held in one hand in a manner that permits firm control of camera position and security against dropping the camera. The device includes a finger strap designed to firmly circle the middle, ring, and little fingers of the hand while leaving the index finger and thumb free, and a yoke which can be readily attached to a camera and which holds the strap at one side thereof. The finger strap forms a loop which is positioned so that the axis of the loop is inclined upwardly, as seen in a side elevation view, and is angled toward the optical axis of the camera, as seen in a plan view. This loop orientation enables the hand to grip the camera in a natural manner, while leaving the index finger free to reach over the top of the camera to operate the shutter release button and also leaving the thumb free to operate the film advance lever.

The yoke which supports the strap, is formed of a single piece of leather or other flexible material which is originally in a sheet form. The yoke has a middle portion lying around one side of the camera and attached to the finger strap, and has a pair of yoke straps with one extending over the front and bottom of the camera and the other extending over the rear and bottom of the camera to the tripod socket location. The ends of the yoke straps are held by a knob extending through slots at the end of the straps and into the threaded tripod socket typically formed at the bottom of 35mm cameras. The middle of the yoke is held to the camera by a hole in the yoke which receives a neck-strap lug.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
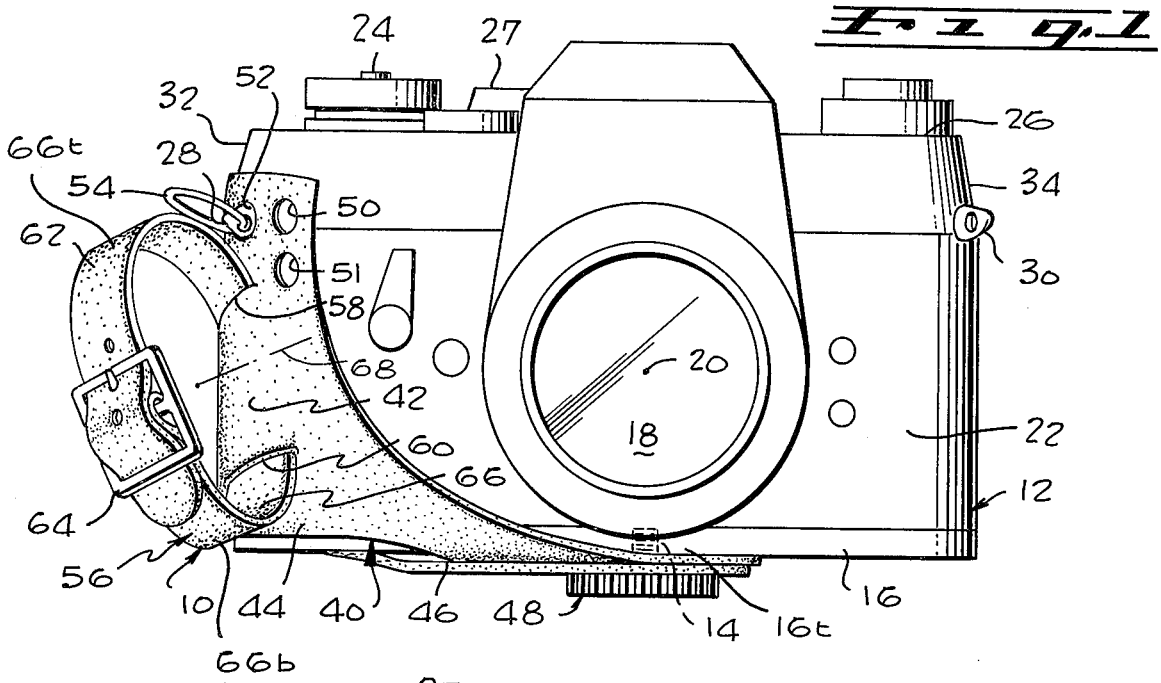
FIG. 1 is a front elevation view of the camera side strap of the present invention, shown monted on a camera.
Figure 3:
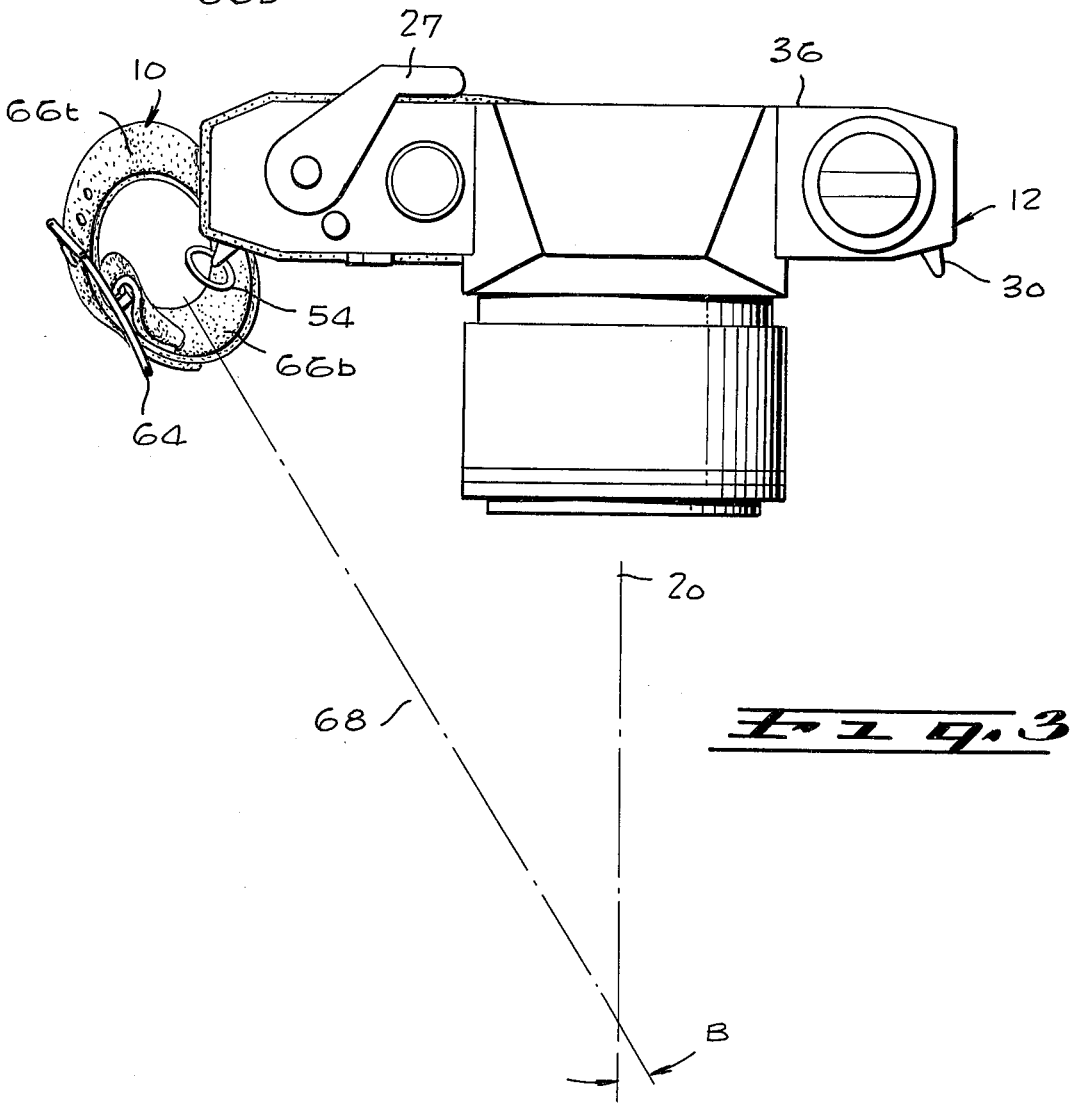
FIG. 3 is a plan view of the arrangement of FIG. 1.
Figure 2:
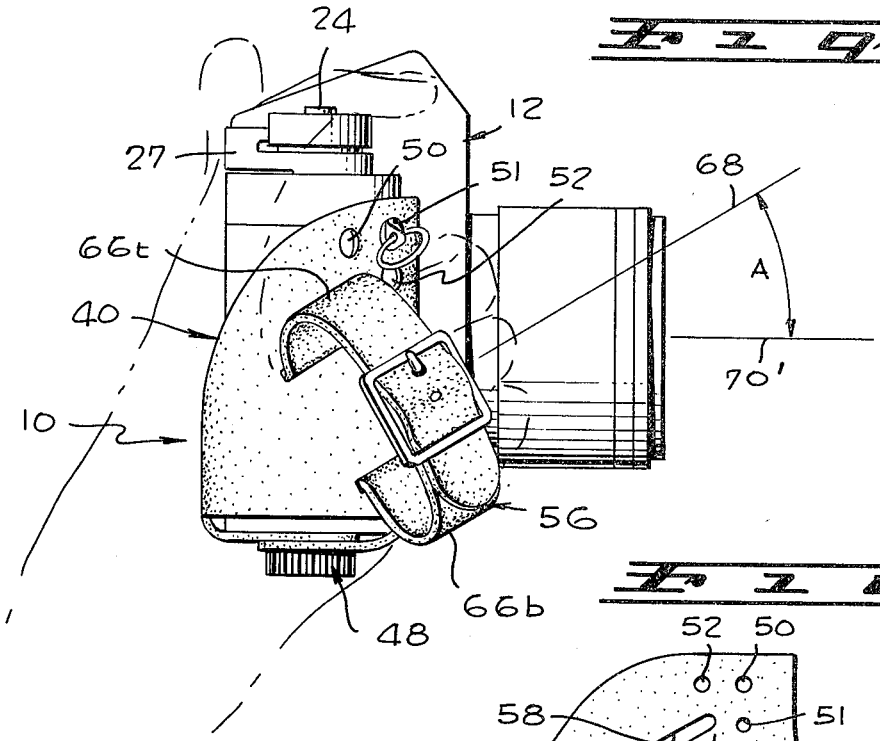
FIG. 2 is a right side elevation view of the arrangement of FIG. 1.

FIGS. 1–3 illustrate the camera holding apparatus 10 which is mounted on a camera 12 of the typical overall shape of those using 35mm film. The camera has a threaded hole or socket 14 in the middle of its bottom wall 16, for mounting on a tripod, and has a lens 18 through which light passes along an optical axis 20 extending normal to the front wall 22 of the camera body. A shutter release button 24 is typically located at the top or top wall 26 of the camera at the right side of the camera body, although some cameras utilize a shutter release at the right side of the front wall 22 instead of on top. A film advance lever 27 extends rearwardly at the top of the camera. Two neck-strap lugs 28, 30 are located on the right and left side walls 32, 34 of the camera, and are typically used for receiving the ends of a neck strap. The camera also includes a rear wall 36 containing a pivotally mounted cover through which film is received and removed.

The camera holding apparatus 10 includes a yoke 40 with a middle portion 42 which lies at the right side of the camera and a pair of yoke straps 44, 46 which extend from the middle portion to the tripod socket location 16t at the middle of the camera bottom wall. A knob 48 which screws into the threaded tripod socket 14 holds the outer ends of the straps to the camera. The middle portion 42 of the yoke has three holes 50, 51, 52, one of which fits around the neck strap lug 28 of the camera. A split type key ring 54 which attaches to the neck strap lug 28 and which if of much larger diameter than the hole 50, assures that the yoke will not slip completely away from the lug 28. A finger strap 56 which closely receives some of the fingers of the hand, is mounted on the middle portion 42 of the yoke. The yoke has a pair of slots 58, 60 and the finger strap 56 passes through these slots to mount the finger strap on the yoke.

The finger strap 56, which includes a strip 62 of flexible material such as leather and a buckle 64, forms a loop 66 designed to closely receive the lower three fingers of the hand, these being the middle, ring and little fingers. The lower three fingers which are received through the loop, can firmly grasp the front of the camera while the heel portion of the hand lying below the thumb presses against the back of the camera, so that the camera can be held securely. This grasping configurations leaves the index finger and thumb free to perform other chores. The index finger is free to reach over the top 26 of the camera to depress the shutter release button 24 (or to reach over the front wall of the top thereof for those cameras having a shutter release thereat), while the thumb is free to operate the film advance lever 27.

The orientation of the strap 56 and of the loop 66 formed thereby, is carefully chosen so that when the lower three fingers are fully inserted through the loop with the lowermost or base joints of the fingers enveloped by the strap, the index finger is free to reach over the top of the camera to depress the shutter release button. To accomplish this, the axis 68 of the loop is angled away from an orientation parallel to the optical axis 20. The loop axis 68 is an imaginary line passing through the center of the loop and perpendicular to the plane of the loop. In particular, the loop axis 68 is upwardly and forwardly inclined, as seen in a side elevation view as in FIG. 2 where the loop axis 68 is seen to extend at an angle A from an imaginary horizontal line 70'. By an upward-forward incline, it is meant that the loop axis 68 extends upwardly at locations progressively more forward, so that the top 66*t* of the loop (or of the finger strap 56) lies rearward of the bottom 66*b*as seen in the side elevation view. In addition, the loop axis 68 as seen in the plan view of FIG. 3, is angled "inwardly" toward the optical axis 20 at an angle B.

If the side strap were oriented so that the loop axis 68 were parallel to the optical axis 20, then the camera still could be grasped by the fingers extending through the loop. However, the index finger initially would be pointing straight ahead, and it would be difficult for the photographer to move his index finger over the top of the camera to the shutter release button without withdrawing his lower fingers partially from the finger strap loop. By tilting the strap by the angle A as seen in FIG. 2, the index finger also points at an upward incline and can more easily reach over the top of the camera. By also angling the loop axis by the angle B as seen in FIG. 3, the index finger initially points inwardly and can even more easily reach the shutter-release button. By utilizing this angling B, and by locating the strap 56 near the front of the camera instead of at the middle of the camera side wall, the lower three fingers of the hand can more securely and comfortably grasp the front of the camera. Thus, the positioning of the loop on the axis 68 allows the lower fingers to fit the loop naturally as if they were grasping the camera alone without a loop. This provides a comfortable and unstrained grip for those fingers and a workable position for thumb and index.

The angling of the loop axis at an upward incline, and also inwardly or towards the optical axis as seen in a plan view, allows the lower three fingers to project fully through the loop while the hand extends in a natural manner to hold the camera up to the eye and point it forwardly. The photographer can operate the shutter release button and film advance lever and then lower the camera to make adjustments or change lenses, all without changing the position of the fingers which extend through the finger strap, and all the time securely holding the camera with his lower three fingers and knowing that even if his fingers slip the camera cannot fall out of his hand.

Figure 5:
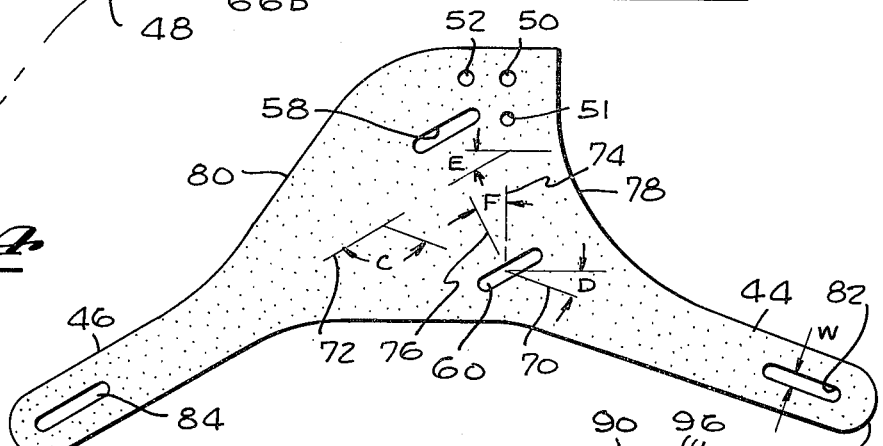
FIG. 5 is a front view of the yoke of FIG. 2 showing its configuration when it is laid flat.
Figure 4:
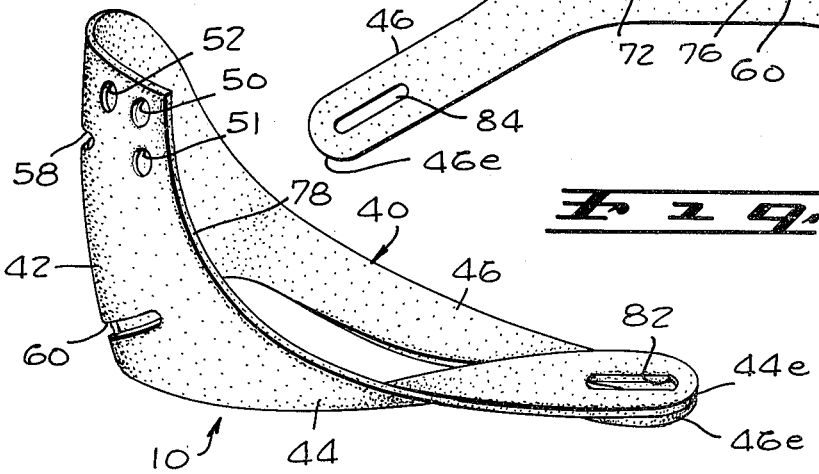
FIG. 4 is a front, top, and a side perspective view showing the yoke of the side strap of FIG. 1 in the configuration which it assumes when mounted on a camera.

The yoke 40 is designed so that it can be constructed of a tough flexible material such as leather, which is a material having a feel and appearance that are readily acceptable in camera accessories. In order to permit low cost manufacture of the yoke from sheets of leather, the yoke is designed so that it can lie flat and so that a one-piece yoke can be installed on a camera by the simple bending of any portion thereof. The yoke is originally formed in the configuration shown in FIG. 5, with the middle yoke portion 42 having a height slightly less than that of a camera side wall. The front and rear yoke straps 44 and 46, both extend at downward inclines so that the angle C between imaginary strap axes or center lines 70, 72 is less that 180°. The particular yoke shown in FIG. 5 is designed with the forward strap axis 70 extending at a downward angle D of 20° and the rearward strap axis 72 extending at a downward angle E of 30°, so that the angle C is 130°. These downward inclines are taken with respect to an imaginary vertical line 74 which normally extends vertically when the yoke is mounted on a camera. The strap-receiving slots 58, 60 which receive the finger strap, are oriented with their center line 76 at an angle F of 25°from the vertical line 74. The yoke periphery is formed with generally continuous curvatures, with the front edge 78 being concave to prevent interference with various controls often present on the front face of the camera, and with the rear edge 80 being convex and straight so that the rear strap 48 can extend at a greater downward incline to more readily bend around the rear-bottom edge of the camera. The three lug-receiving holes 50–52 are positioned to enable the yoke to mount on a large number of different camera models which have neck-strap lugs at slightly different positions. One of the holes 50 is sufficient for a large majority of the cameras, while the other two holes can accomodate most of the other cameras.

Figure 8:
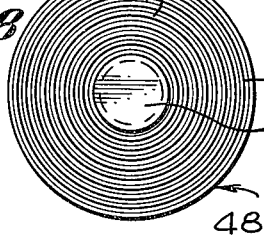
FIG. 8 is a plan view of the knob of FIG. 7.
Figure 7:
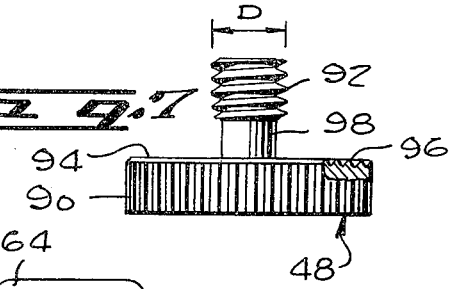
FIG. 7 is a side elevation view, particularly in section, of the knob of the arrangement of FIG. 1.
Figure 6:
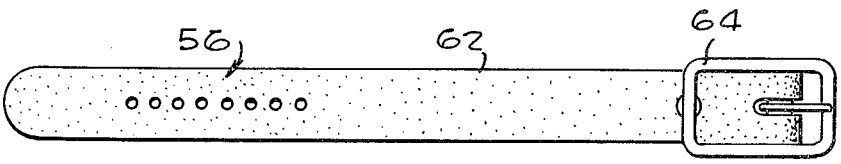
FIG. 6 is a front view of the strap of the arrangement of FIG. 1, showing its configuration when laid flat.

The free ends 44*e*, 46*e* of the yoke straps are provided with elongated slots 82, 84 so that the straps can be attached to cameras of a range of sizes. When the yoke is positioned on a camera with the straps lying on one another, the knob 48 is screwed into the threaded tripod socket 14 in the camera and tightened against the straps. In order to allow a photographer to confidently hold the camera by the finger strap, it is necessary that the yoke be tightly attached to the camera. This means that the yoke straps 44, 46 should not be able to slide along the camera bottom wall so as to loosen the yoke. The knob 48, which is shown in detail in FIGS. 7 and 8, is designed to prevent slippage of the yoke straps. The knob 48 includes a head 90 with a knurled periphery to prevent finger slippage during tightening and loosening, and with a threaded shank 92 which is designed to thread into the camera tripod socket. The upper face 94 of the knob head is formed with several circular ridges 96 that extend concentric with the axis of the knob and completely around the knob axis. An upper knob face which is merely rough can be utilized, but circular ridges provide better holding with less wear of the leather strap. When the knob is inserted through the slots in the yoke straps and into the camera and then tightened, the ridges 96 tend to indent the lowermost strap end such as 46*e* to form a high friction engagement that resists sliding of the strap end on the knob. The pressure of the two strap ends 44*e*, 46*e* against one another can prevent relative slippage where the yoke is made of a material having a high coefficient of friction on itself such as leather. The bottom of the camera is often constructed of smooth metal which may not provide a high coefficient of friction with leather or other material of the yoke. However, so long as the upper yoke strap 44 cannot slip on the lower strap 46 and the lower strap 46 cannot slip on the knob 48, the yoke will not slip along the camera and the yoke will remain tightly mounted on the camera.

In normal use, the yoke is allowed to remain indefinitely or even permanently on the camera. However, the rear strap 46 must be released to allow the rear cover to be opened and closed each time film in the camera must be replaced. This can be accomplished by merely unscrewing the know 48 so that the free ends 44*e*, 46*e* of the yoke strap are loose. When the knob 48 is completely unscrewed from the camera, it would be possible for the knob to fall to the ground and become lost, unless special provisions are made to prevent this. In order to prevent loss of the knob, the slots 82, 84 of the yoke straps have a width W which is less than the outer diameter D of the threaded shank 92 of the knob. As a result, there is an interference fit between the knob shank and the walls of the yoke straps, so that when the knob is unscrewed and the straps can fall away from the camera, the knob tends to remain on the straps. In fact, the knob tends to hold the straps together so that remounting of the straps and knob can be made with little effort. The repeated turning of the threaded knob shank 92 in the slots can tend to enlarge them so that after a long period of use the knob might fall away from the straps whenever the knob was loosened. To minimize such wearing away of the straps, the knob 48 is provided with a reduced diameter base portion 98 whose length is about the same as the thickness of the two strap ends one laid on one another.

Figure 9:
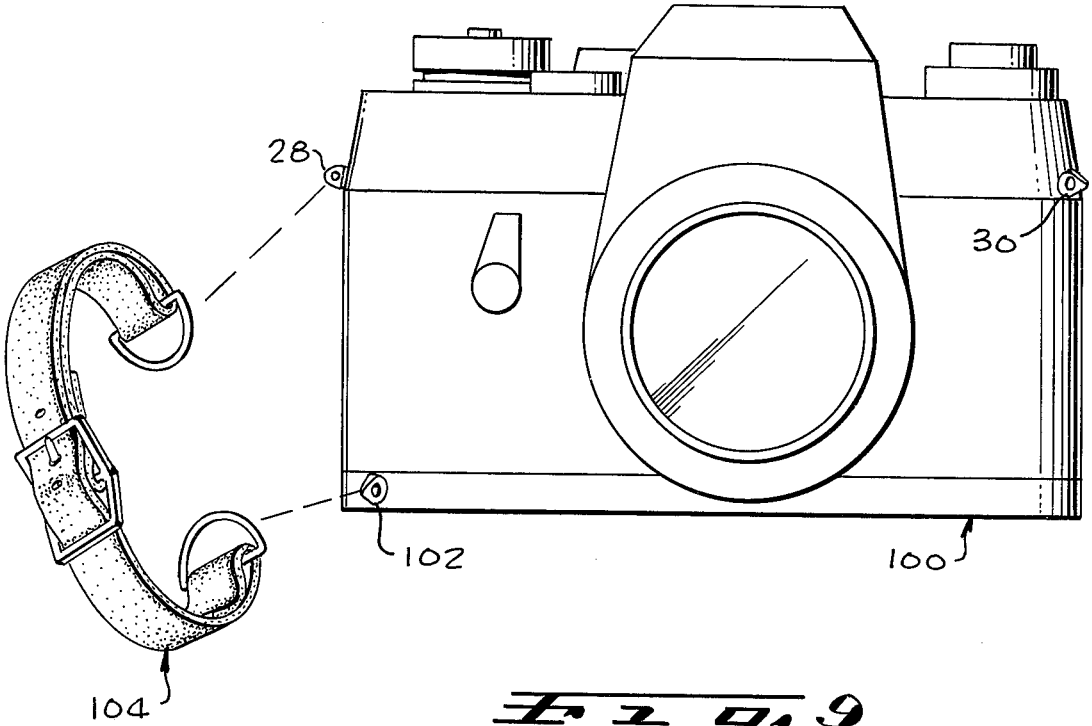
FIG. 9 is a perspective exploded view of a camera side device constructed in accordance with another embodiment of the invention.

The yoke 40 can be utilized in a variety of configurations and for a variety of purposes. Although the yoke is especially useful for mounting on the right side of the camera where the shutter release button is normally located, it is possible to construct the yoke for mounting on the left side of the camera, as for enabling the camera to be easily held by a left handed person. The same yoke design as shown in FIG. 5 may be utilized, except that the sheet of leather from which the sheet is cut would be turned over so that the smooth side faces into the paper instead of out of it as seen in FIG. 5. The simple yoke also can be adapted for holding devices other than a finger strap. For example, a belt clip can be mounted to the yoke to enable the camera to be carried at the waist of a photographer. It also should be noted that the finger strap may be attached by yokes of a variety of designs to a camera to form a finger-receiving loop that is angled upwardly and inwardly from an imaginary line parallel to the optical axis, to enable comfortable and secure holding of a camera while also allowing the index finger and thumb to be free for other operations. FIG. 9 illustrates a camera 100 with a lug 102 located below and forward of the neck strap lug 28, for receiving a finger strap 104 with split rings at its ends, the strap forming a loop in which the camera body forms one side of the loop.

Thus, the invention provides a finger strap held at a side of a camera, at an orientation which enables secure camera holding during active use of the camera in picture taking, and also provides a yoke of simple and economical design for mounting on a camera. The finger strap is designed to receive a plurality of lower fingers of the hand, preferably the middle, ring and little fingers although only two of the lower fingers is sufficient to hold up a camera. The loop formed by the finger strap is angled upwardly and forwardly as seen in a side elevation view and is angled inwardly, or towards the optical axis as seen in a plan view. The yoke is formed of flexible material with a middle portion lying at one side of the camera and with yoke straps extending over the front of rear and over the bottom of the camera and with the free ends of the straps held to the bottom of the camera by a knob threaded into the tripod socket at the bottom of the camera.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privelege is claimed are defined as follows:

1. A camera assembly comprising:

a camera having a body with front, rear, side, top, and bottom walls and having means defining an optical axis portion which extends in a direction substantially normal to the plane of said front wall through the center portion thereof, hand strap means forming a loop for closely receiving a plurality of fingers; and means coupled to said camera body for holding said hand strap means to said camera body near one side of said camera, said holding means holding said hand strap means with one side of said loop next to said camera body to allow fingers extending through the loop to grasp the camera body, and with the axis of the loop extending at a forward-upward incline as seen in a side elevation view, and with the forwardly-extending portion of the axis of the loop angled inwardly toward the optical axis as seen in a plan view.

2. The camera assembly described in claim 1 wherein:

said camera includes walls defining a threaded tripod-mount hole in its bottom and a pair of neck-strap lugs on either side; and said means for holding said hand strap means includes a yoke of flexible material with a middle portion lying over a side of the camera and coupled to said hand strap means and a pair of yoke straps extending respectively over the front and rear walls of the camera body and with outer ends lying over the bottom wall, means engaged with said tripod mount hole for holding said outer strap ends to the camera body, and means engaged with one of said neck-strap lugs for securing said yoke middle portion to the camera body.

3. Apparatus for holding to a camera that has front, rear, side, bottom and top walls, and which has a threaded hole in the middle portion of the bottom wall, comprising:

a yoke having a middle yoke portion for lying against a side wall of the camera body and a pair of straps extending in substantially opposite directions from said middle yoke portion to extend to the threaded hole in the camera bottom wall with one strap extending over the front and bottom walls and the other strap extending over the rear and bottom walls and with the outer ends of said straps lying over one another at the threaded hole, each of said straps having a hole in its outer end; and a knob having a head for lying under the outer strap ends and a threaded shank for extending upwardly from said head to project through said holes in said straps and threadably engage said threaded hole in said camera bottom wall.

4. The apparatus described in claim 3 wherein:

at least one of said holes in said straps has a width less than the outer diameter of said threaded shank of said knob to form an interference fit therebetween, whereby when the knob is unscrewed to allow the back of the camera to be opened for film replacement the knob is held to the straps instead of dropping out to the ground.

5. The apparatus described in claim 3 in which the camera has neck strap lugs near the upper ends of its side walls and wherein:

said middle yoke portion has a hole near its upper end for passing one of said neck strap lugs, and including a retainer for fastening to one of said lugs and having a larger width than said hole in said middle yoke portion, to hold the upper portion of the yoke securely to the camera.

6. The apparatus described in claim 3 including:

a finger strap mounted on said middle portion of said yoke for receiving at least the middle and ring fingers of the hand while leaving the index finger and thumb free, said finger strap being angled at least a few degrees from an imaginary vertical line, so that the top of the strap lies rearwardly of the bottom when the yoke is mounted on a camera.

7. The apparatus described in claim 3 wherein:

said holes in said outer ends of said straps are elongated slots and said straps have a high coefficient of friction on one another; and the head of said knob has an upper face with at least one rib extending in substantially a circle around said shank, for depressing into one of said straps to resist slippage of the straps when the knob is tightened.

8. Apparatus for attachment to a camera comprising:

a yoke formed of a plate of flexible material which can be laid flat, said yoke having a middle portion with upper and lower ends and forward and rearward portions, a forward strap extending from said forward portion, and a rearward strap extending from said rearward portion;

each of said straps being elongated and extending sidewardly with a downward incline of at least a few degrees so that the angle between said straps is less than 180°, and the outer end portion of each of said straps having a knob-receiving hole therein;

the middle portion of said yoke having at least one lug-receiving hole in the upper portion thereof, whereby the yoke can be formed from a sheet of leather or the like and wrapped around a camera with the straps wrapped respectively over the front and rear and onto the bottom and held thereon by a knob passing through the strap holes into the tripod mount hole of the camera, and with the middle yoke portion lying on a camera side with the lug-receiving hole receiving a neck strap lug of the camera and secured by a retainer attached to the lug and lying over the yoke.

9. The apparatus described in claim 8 wherein:

said middle yoke portion has a pair of slots for receiving a finger strap, said slots being vertically spaced and with the upper slot lying rearwardly of the lower slot; and a finger strap projectable through said slots to form a loop.

10. Apparatus for holding a camera having side, front, rear, top and bottom walls, and a tripod socket at the middle portion of the bottom wall comprising:

finger strap means for forming a loop that receives at least some of the fingers; and means for attaching said finger strap means to a camera, including a yoke with a middle portion lying against a side of the camera and coupled to said finger strap means, and with a pair of yoke straps extending respectively from the forward and rearward parts of the middle yoke portion, one of said yoke straps extending over the front and bottom camera walls to the tripod mount and the other yoke strap extending over the rear and bottom camera walls to the tripod mount, and said means for attaching also includes fastener means mountable on said tripod mount for holding said straps.

* * * * *